United States Patent [19]

Jones

[11] Patent Number: 4,467,494

[45] Date of Patent: Aug. 28, 1984

[54] INDUSTRIAL VACUUM CLEANER

[76] Inventor: Judson O. Jones, 6 Persimmon La., Greenville, S.C. 29609

[21] Appl. No.: 369,572

[22] Filed: Apr. 19, 1982

[51] Int. Cl.[3] ..... A47L 9/14

[52] U.S. Cl. ..... 15/353; 15/352; 55/364; 55/379; 55/436

[58] Field of Search ..... 15/347, 352, 353; 55/DIG. 3, 337, 364, 379, 380, 436

[56] References Cited

U.S. PATENT DOCUMENTS

| | | | |
|---|---|---|---|
| 2,627,936 | 2/1953 | Martinet | 15/327 D X |
| 3,172,743 | 3/1965 | Kowalewski | 55/214 |
| 3,774,260 | 11/1973 | Emus | 15/321 |
| 3,813,725 | 6/1974 | Rinker | 15/347 |
| 3,821,830 | 7/1974 | Sundheim | 15/321 |
| 3,874,152 | 4/1975 | Dahl | 15/347 X |
| 3,961,921 | 6/1976 | Heiman et al. | 55/364 X |
| 4,216,563 | 8/1980 | Cyphert | 15/321 |

*Primary Examiner*—Chris K. Moore

*Attorney, Agent, or Firm*—Julian W. Dority

[57] ABSTRACT

An industrial vacuum cleaner for collecting fibers collecting lint and the like and using said fibers as a filtration medium for air being exhausted from the cleaning system. The apparatus includes a positive displacement pump which draws the lint-laden air into a cylindrical housing having a plastic bag positioned therein which has holes provided therein. The plastic bag is, in turn, carried into a woven filter bag which is, in turn, carried within a rigid cylindrical mesh liner. As a result, the lint collected is removed from the air and builds up along the side walls of the plastic liner providing a filtration medium for lint-laden air subsequently drawn therein.

4 Claims, 4 Drawing Figures

Fig. 3.
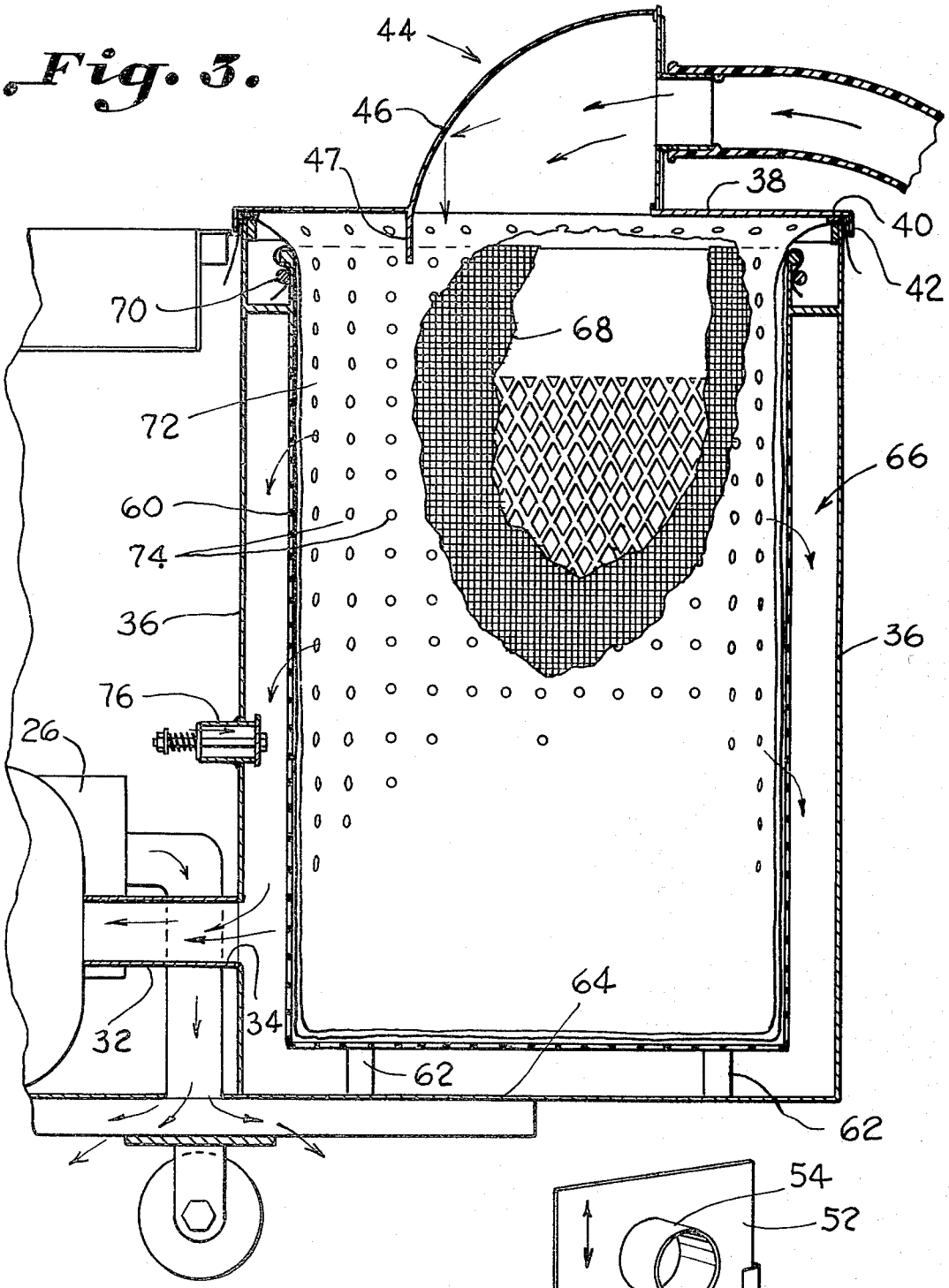
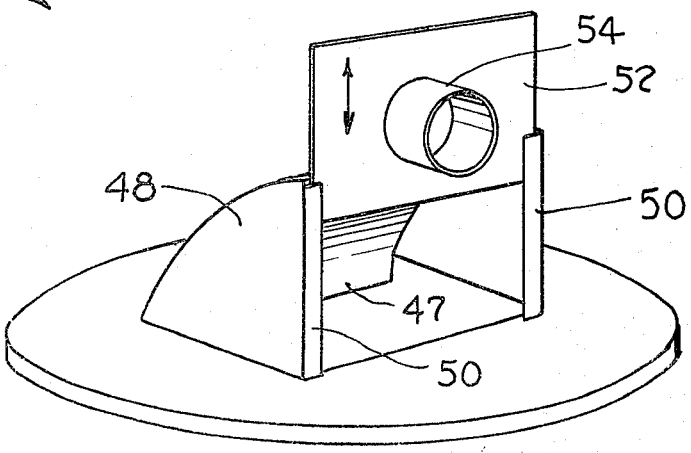
Fig. 4.

INDUSTRIAL VACUUM CLEANER

BACKGROUND OF THE INVENTION

Heretofore, vacuum systems have normally utilized centrifugal blowers for creating a vacuum on a hose used in conventional vacuum cleaners. One problem with such systems is that as the media collected during the cleaning process collects within the collecting tank, the vacuum pump will tend to cavitate. Another problem is that normally the centrifugal blower is provided on top of the trash collecting container permitting the collected media to drop or be deposited in the container.

Examples of a typical cleaning machine are disclosed in U.S. Pat. Nos. 3,902,219, 3,496,592, and 3,619,849.

SUMMARY OF THE INVENTION

In order to produce a high powered industrial vacuum cleaner system for removing lint laden particles and collecting same in a plastic bag for disposal as well as filtering the exhaust air, a device constructed in accordance with the present invention utilizes a positive displacement vacuum pump that is driven by an electric motor. A vertically extending cylindrical housing having a closed bottom and side walls with an open top is carried on a portable frame. A vacuum hose is coupled to the cylindrical housing by means of a vacuum hose receiver carried on a removable top which has an opening communicating with the interior of the cylindrical housing. A rigid cylindrical mesh liner is carried in the housing and has a smaller diameter than the interior of the housing so as to provide a space between the inner wall of the housing and the outer wall of the mesh liner. A porous burlap filter bag is carried in the mesh cylindrical liner and is attached adjacent its open top end by means of a spring-loaded ring. A plastic filter bag is carried within the woven filter bag and has spaced holes of approximately one-half inch (½") in diameter which are spaced from each other approximately two inches (2"). The upper end of the filter bag extends over the top of the cylindrical housing and is secured therein by the pressure of the top of the cylindrical housing pressing down thereon.

An input of the positive displacement pump communicates with the lower portion of the cylindrical housing for drawing lint-laden air into the plastic bag carried in the cylindrical housing and the burlap bag along with lint previously collected filters the air so that clean air is exhausted out of the positive displacement pump. A vacuum hose receiver is provided for connecting a plurality of vacuum hoses to the top of the cylindrical housing during the vacuum operation.

Accordingly, it is an important object of the present invention to provide an industrial vacuum cleaner for collecting lint-laden media while exhausting clean filtered air.

Another important object of the present invention is to provide a high capacity industrial vacuum cleaner wherein lint and the like can be collected in a plastic bag carried within a housing and readily disposed of without adversely affecting the efficiency of the vacuum cleaning system.

Still another important object of the present invention is to provide an industrial vacuum cleaner which is simple in construction while using an efficient powerful vacuum cleaning system for cleaning textile mills and the like.

These and other objects of the present invention will be more readily understood from a reading of the following specification and by reference to the accompanying drawings forming a part thereof, wherein an example of the invention is shown and wherein:

BRIEF DESCRIPTION OF THE DRAWING

FIG. 3 is an enlarged sectional view showing the cylindrical housing and mechanism for collecting lint and the like within the vacuum cleaner.

FIG. 4 is a perspective view illustrating a modified form of a vacuum hose receiver that can be used with the industrial vacuum cleaner.

DESCRIPTION OF A PREFERRED EMBODIMENT

Figure 1:
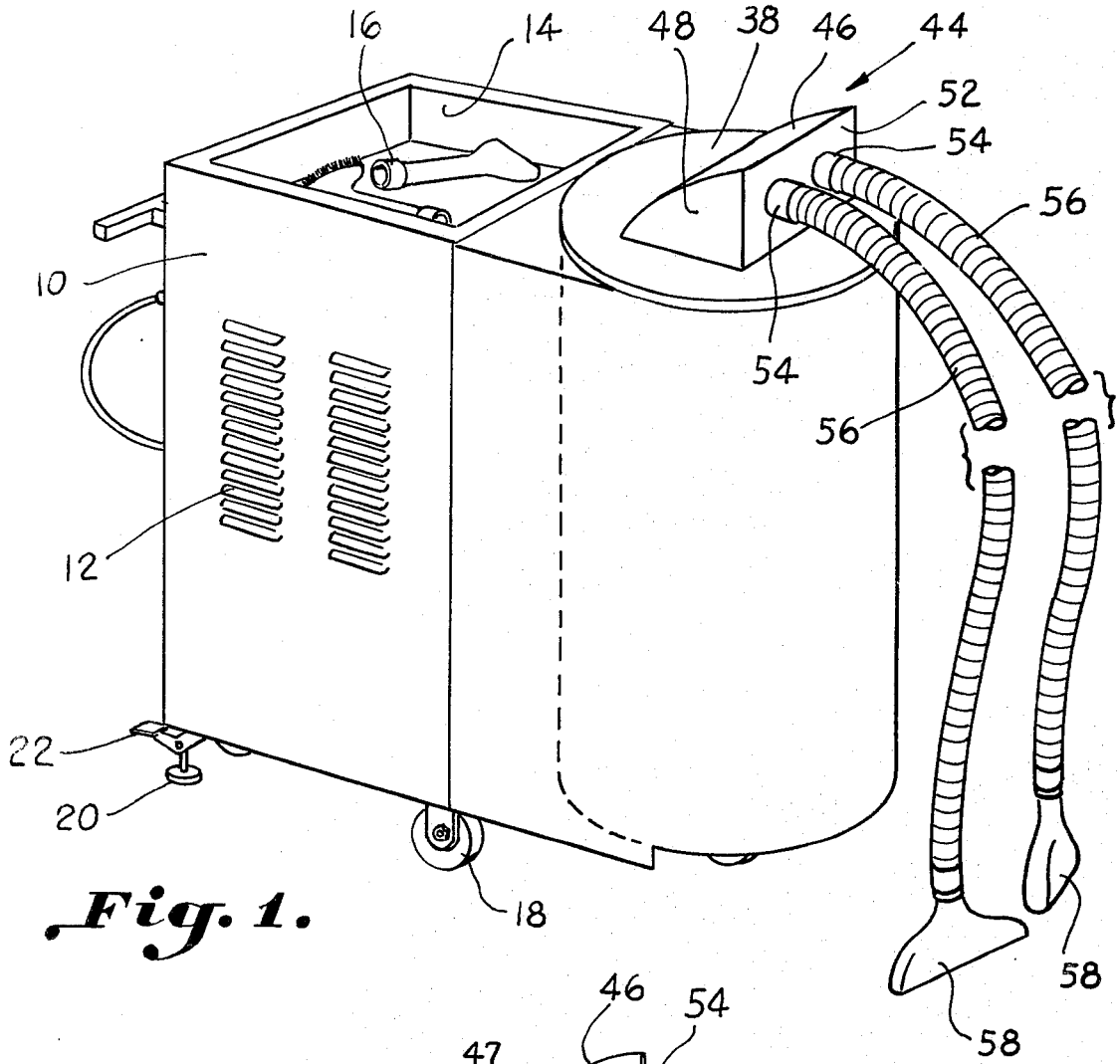
FIG. 1 is a perspective view illustrating an industrial vacuum cleaner constructed in accordance with the present invention.
Figure 2:
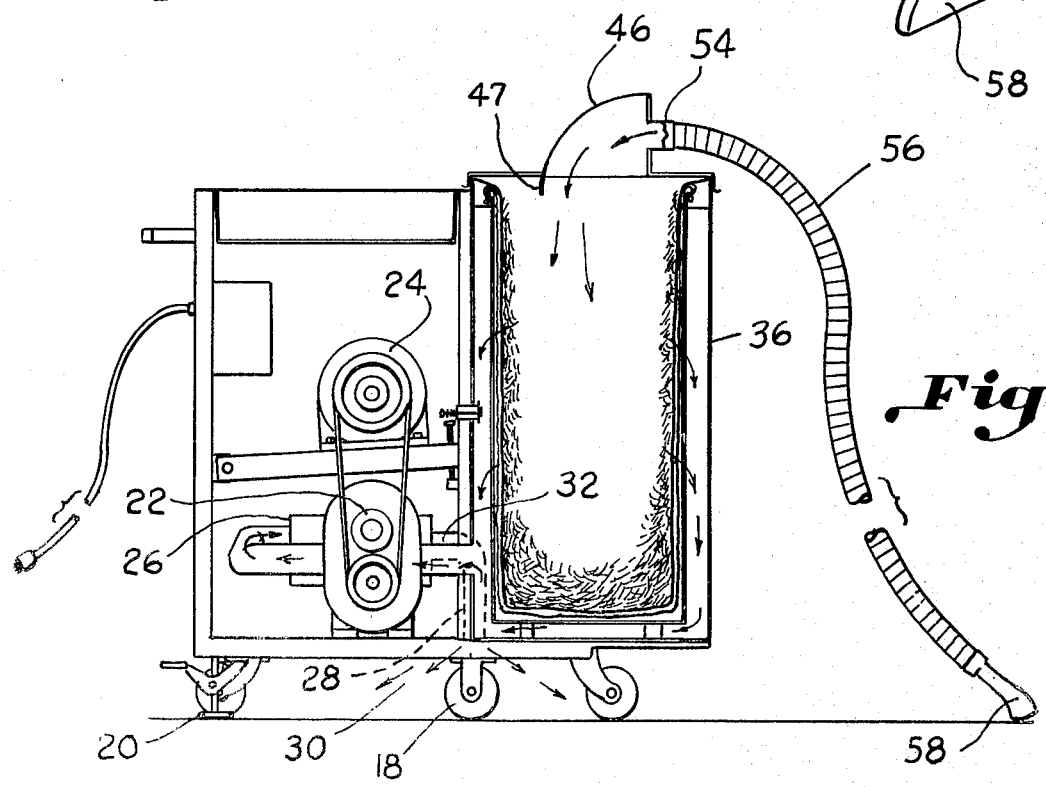
FIG. 2 is a sectional view showing the interior of the vacuum cleaner of FIG. 1.

Referring in more detail to FIG. 1 of the drawing, there is illustrated an industrial vacuum cleaner constructed in accordance with the present invention.

The vacuum cleaner includes side walls 10 constructed of sheetmetal which have vent louvers 12 provided therein through which air flows for cooling the electric motor carried therein. A receptacle 14 is provided on the top of the vacuum cleaner into which various cleaning implements 16 can be positioned while not in use. The vacuum cleaner is supported on casters 18 which are positioned substantially in the middle bottom portion of the vacuum cleaner. Adjustable support feet 20 are carried adjacent two corners so that when they are depressed down by maneuvering a foot lever 22, it prevents the vacuum cleaner from moving. When it is desired to move the vacuum cleaner to a different position, the locking feet 22 are lifted and the entire vacuum cleaner is moved on the casters 18.

A positive displacement pump 22 is carried within the side walls of the vacuum cleaner adjacent the open louvers 12. The positive displacement pump is driven by an electric motor 24 of approximately ten horsepower. An output of the positive displacement pump is fed through a muffler 26 for reducing the noise thereof during operation. The output of the muffler is fed through a downwardly extending pipe 28 for exhausting air below the vacuum cleaner as indicated by the arrows 30. An input of the positive displacement pump 22 is connected through a tubular conduit 32 to an opening 34 provided in a lower portion of the vertically extending cylindrical housing 36. The cylindrical housing 36 is constructed of heavy gauge metal so as to prevent it from collapsing when a strong vacuum is produced therein. A removable top 38 extends over an open top portion of the cylindrical housing 36 and a seal 40 is provided between the upper edge of the top portion of the housing 36 so as to minimize air leaks therebetween. The top 38 has downwardly extending flanges 42 which extend down below the upper edges of the open top cylindrical housing.

A vacuum hose receiver 44 is integral with the removable top and includes an arcuate-shaped upper portion 46 which extends down below the top 38 into the cylindrical housing (as shown by the portion 47). The arcuate-shaped top 46 is joined by side walls 48 which have inwardly turned flanges 50 provided thereon which define a track for receiving a flat adapter plate 52. The flat adapter plate 52 has a tubular member 54 extending outwardly therefrom upon which flexible hoses 56 can be pressed thereon. The other end of the flexible vacuum hoses 56 have cleaning tools 58 provided thereon. As can be seen in FIG. 4, a single tubular member 54 may be provided in the plate 52 or a pair of tubular members 54 may be provided as shown in FIG. 1.

A rigid cylindrical mesh liner 60 is carried within the cylindrical housing 36 and supported on blocks 62 extending between the bottom thereof and the bottom portion 64 of the cylindrical housing 36. The diameter of the cylindrical mesh liner is smaller than the internal diameter of the housing so that a space 66 is provided therebetween.

A porous woven burlap filter bag 68 is carried within the rigid cylindrical mesh liner 60 and has an open top. The top edge of the porous bag is bent back down over the top of the mesh liner and secured thereto by means of a spring-loaded ring 70 which extends around the mesh liner.

A plastic bag 72 is carried within the woven filter bag 68 and has spaced holes 74 provided therein. The holes are approximately one-half inch (½") in diameter with a spacing between adjacent holes being approximately two inches (2"). The upper edge of the open plastic bag 72 extends over the rim of the cylindrical housing 36 and is secured therein by the weight of the top pressing downwardly thereon.

The cylindrical housing 36 has a pressure relief valve 76 provided in the wall thereof so that if the vacuum within the cylindrical housing 36 reaches a predetermined level, the spring-loaded relief valve 76 will reduce the vacuum preventing the housing from collapsing under extreme pressure.

In operation, an operator will either use a single hose or if two operators are operating from the same machine then the adapter plate 54 having two hoses is utilized. As the lint-laden air is picked up by the vacuum hose as is the case when cleaning a textile mill, the lint-laden air is deflected by the deflector plate 47 down into the center portion of the plastic bag. The lint will tend to start collecting adjacent the bottom of the plastic bag and build up along the side walls since the air flowing through the holes in the plastic bag will tend to take the path of least resistance. After the lint is built up a sufficient amount, the lint-laden air is drawn through the lint already collected in the plastic bag which acts as an additional filter. When the plastic bag is completely full, it is merely removed from the cylindrical housing and thrown away. Very little lint is left on the inner surface of the burlap bag and substantially no lint passes through the positive displacement pump 42.

While a preferred embodiment of the invention has been described using specific terms, such description is for illustrative purposes only, and it is to be understood that changes and variations may be made without departing from the spirit or scope of the following claims.

What is claimed is:

1. An industrial vacuum cleaning system for collecting fibers containing lint and the like using said collected fibers as a filtration medium for subsequent lint laden air collected comprising:

a positive displacement vacuum pump;

a motor driving said positive displacement vacuum pump producing a high vacuum;

a vertically extending cylindrical housing having a closed bottom, and side wall, and an open top;

a removable top extending over said open top;

a vacuum hose;

a vacuum hose receiver carried on said removable top having an opening communicating with the interior of said cylindrical housing through which media collected by said vacuum hose passes into said cylindrical housing;

a cleaning head carried on a remote end of said vacuum hose;

a rigid cylindrical mesh liner carried in said housing of a smaller size than said cylindrical housing producing a space between said cylindrical housing and said mesh liner;

a porous woven filter bag carried in said mesh cylindrical liner; and a plastic bag carried within said woven filter bag having spaced holes provided in a substantially uniform pattern throughout the entire plastic bag, said plastic bag having spaced holes of approximately one-half of an inch (½") uniformly spaced throughout with the remainder of said plastic bag being non-porous;

said filter bag and said plastic bag each having an open top for receiving media entering said cylindrical housing through said vacuum hose, and an input of said positive displacement vacuum pump communicating with a lower portion of said cylindrical housing for drawing media-laden air into said cylindrical housing, through said holes provided in said plastic bag, said porous woven filter bag, said mesh liner and through the space provided between said cylindrical mesh liner and the inner wall of said cylindrical housing.

said positive displacement vacuum pump producing a positive air flow causing said media entering said plastic bag to first cover said holes provided in said plastic bag and compacting said media extending over said holes filtering any subsequent media-laden air entering said cylindrical housing producing a tightly compacted bag of media while said positive displacement vacuum pump maintains a constant high vacuum at said cleaning head.

2. The industrial vacuum cleaner as set forth in claim 1 further comprising:

said vacuum hose receiver including, (i) an arcuate deflection plate joined by spaced vertically extending side walls;

(ii) a lower end of said deflection plate terminating inside said cylindrical housing in a central portion thereof;

(iii) an upper end of said deflection plate along with said side walls providing an entrance opening, and (iv) an adapter plate extending over said entrance opening having a tubular member extending outwardly therefrom for receiving an end of said vacuum hose.

3. The industrial vacuum cleaner as set forth in claim 2 further comprising:

said spaced holes in said plastic being approximately two inches from the next adjacent hole.

4. An industrial vacuum cleaning system for collecting fibers containing lint and the like and using said collected fibers as a filtration medium for subsequent lint laden air collected comprising:

a positive displacement vacuum pump;

a motor driving said postive displacement vacuum pump producing a high vacuum;

a vertically extending cylindrical housing having a closed bottom, and side wall, and an open top;

a removable solid top extending over said open top;

a vacuum hose;

a vacuum hose receiver carried on said removable top having an opening communicating with the interior of said cylindrical housing through which media collected by said vacuum hose passes into said cylindrical housing;

a cleaning head carried on a remote end of said vacuum hose;

a rigid cylindrical mesh liner carried in said housing of a smaller size than said cylindrical housing producing a space between said cylindrical housing and said mesh liner;

a porous woven filter bag carried in said mesh cylindrical liner; and a collection bag carried within said woven filter bag having spaced holes provided in a substantially uniform pattern throughout substantially the entire collection bag, with the remainder of said collection bag being non-porous;

said filter bag and said collection bag each having an open top for receiving media entering said cylindrical housing through said vacuum hose, a pressure relief valve carried in the wall of said cylindrical housing preventing a vacuum buildup within said housing beyond a predetermined value;

an input of said positive displacement vacuum pump communicating with a lower portion of said cylindrical housing for drawing media-laden air into said cylindrical housing, through said holes provided in said collection bag, said porous woven filter bag, said mesh liner and through the space provided between said cylindrical mesh liner and the inner wall of said cylindrical housing;

said positive displacement vacuum pump producing a positive air flow causing said media entering said collection bag to first cover said holes provided in said collection bag and compacting said media extending over said holes filtering any subsequent media-laden air entering said cylindrical housing producing a compacted bag of media while said positive displacement vacuum pump maintains a constant high vacuum at said cleaning head.

* * * * *